United States Patent [19]

Phillips

[11] Patent Number: 4,658,683

[45] Date of Patent: Apr. 21, 1987

[54] HIGH PRESSURE LIQUID CUTTING METHOD

[75] Inventor: Robert Phillips, Epsom, England

[73] Assignee: Jetin Industrial Limited, Epsom, England

[21] Appl. No.: 758,363

[22] Filed: Jul. 24, 1985

[30] Foreign Application Priority Data

Jul. 24, 1984 [GB] United Kingdom ..... 8418860

[51] Int. Cl.[4] ..... B26F 3/00; B24C 1/00

[52] U.S. Cl. ..... 83/53; 51/321; 83/177

[58] Field of Search ..... 83/53, 177; 51/321, 51/320, 319

[56] References Cited

U.S. PATENT DOCUMENTS

| | | | |
|---|---|---|---|
| 3,193,975 | 7/1965 | Millhiser | 51/321 X |
| 3,212,378 | 10/1965 | Rice | 51/321 X |
| 3,978,748 | 9/1976 | Leslie et al. | 83/53 |
| 4,044,507 | 8/1977 | Cox et al. | 51/321 X |
| 4,567,796 | 2/1986 | Kloehn et al. | 83/53 |

FOREIGN PATENT DOCUMENTS

| | | |
|---|---|---|
| 2607097 | 8/1977 | Fed. Rep. of Germany . |
| 2659975 | 9/1984 | Fed. Rep. of Germany . |
| 1566631 | 5/1980 | United Kingdom . |

*Primary Examiner*—Frank T. Yost

*Attorney, Agent, or Firm*—Fleit, Jacobson, Cohn & Price

[57] ABSTRACT

A weld is dressed using a high-pressure abrasive-in-liquid cutting head to remove material from the region of the junction between the weld bead and the adjacent surface portion of the workpiece.

2 Claims, 7 Drawing Figures

20
21
1
22
23a
23c
B
W
F
24

22
23c
1
21
23a
24
B
22
1
W
23b

HIGH PRESSURE LIQUID CUTTING METHOD

DESCRIPTION

The present invention relates to the use of a high pressure liquid cutting apparatus in applications requiring only partial cutting or surface treatment of a workpiece.

It is known to use a high pressure jet of water, sometimes with a stream of abrasive material entrained by the jet, to cut a wide variety of materials including constructional materials such a brick, rock, slate and the like. The water is provided from a very high pressure source typically providing a pressure head of upwards of 10,000 psi (690 bar).

Some apparatuses, where an abrasive stream is used with the water jet, include a mixing head where the jet issues from a nozzle and in so doing entrains the abrasive to carry it along with it.

The present invention relates broadly to the concept of using a very high velocity jet of liquid as provided by a high pressure liquid cutting apparatus for treating a work piece by only partial cutting or surface treatment. This may be used for a variety of purposes, for example the preparation of edges for welding, dressing the edges of welds to relieve weld surface tension and to cut a cavity in a work piece. In each case, the desired degree of removal of material of the work piece or other surface under preparation can be achieved by suitably adjusting the speed at which the jet traces across the surface; the jet has a velocity such that if held stationary it would cut the workpiece but is traced across the workpiece. Depending on the material being worked, the liquid jet may have abrasive particulate material in it to assist in eroding the workpiece surface. Other degrees of rate of material removal can also be achieved by changing the pressure of the water and changing the abrasive.

The invention, and optional features thereof are defined in the appended claims, which form part of this disclosure.

Figure 1:
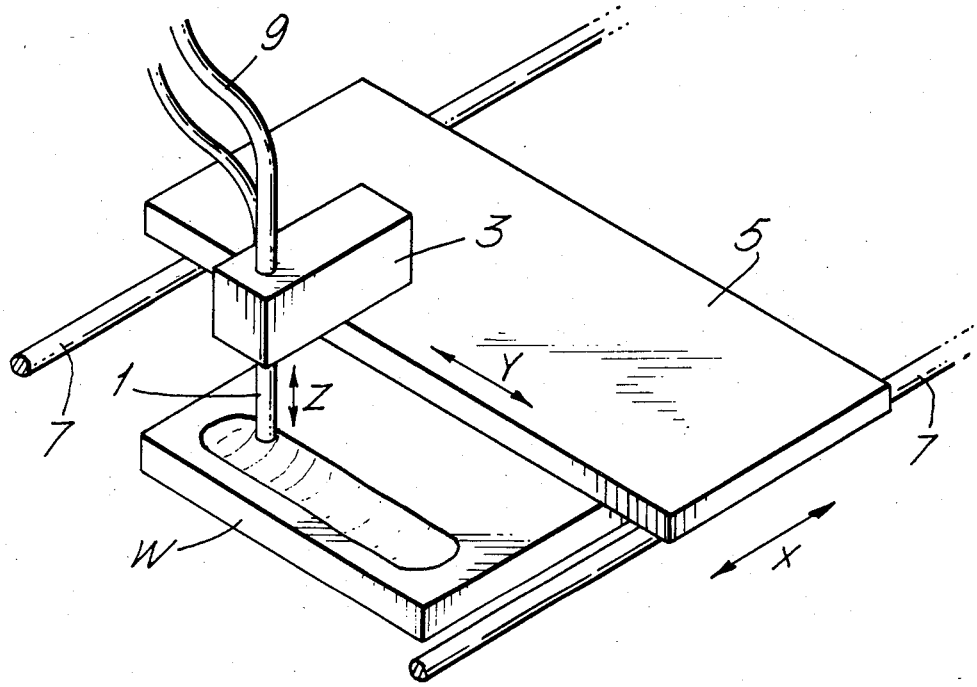
Figure 2A:
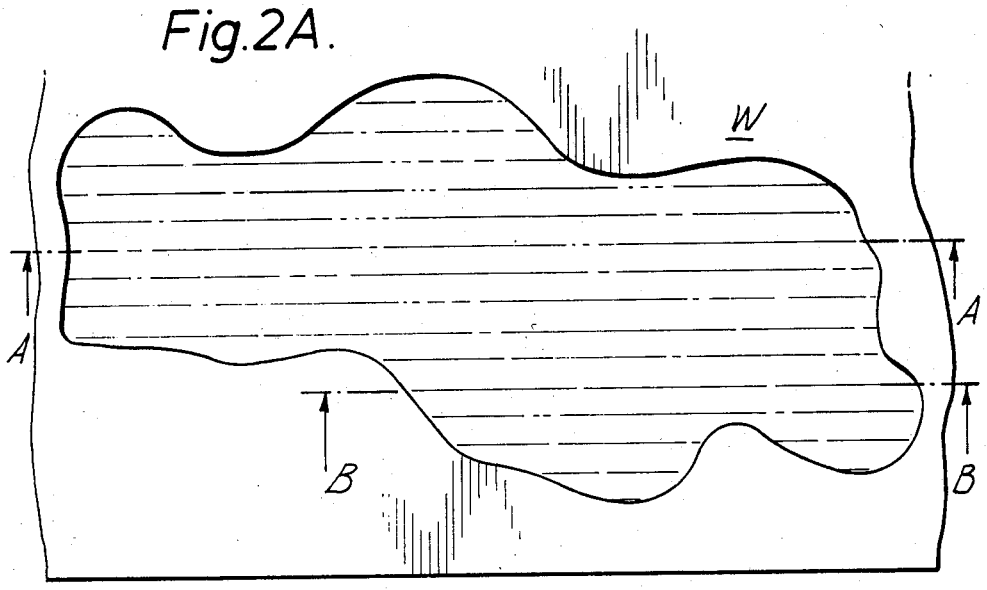
Figure 2B:
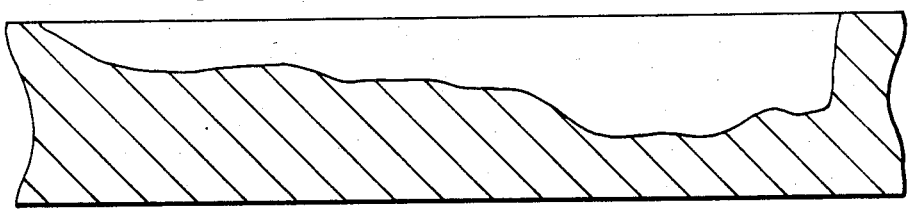

The invention will be further described by way of example with reference to the accompanying drawings in which:

FIG. 1 is a somewhat schematic perspective view of the cutting head of one embodiment of the present invention in a mounting for moving it in the desired manner relative to a work piece;

FIG. 2*a* is a plan view of a mould profile which may be cut using the apparatus of FIG. 1;

FIGS. 2*a* and 2*b* are sections respectively on AA and BB of FIG. 2*a;*

Figure 4:
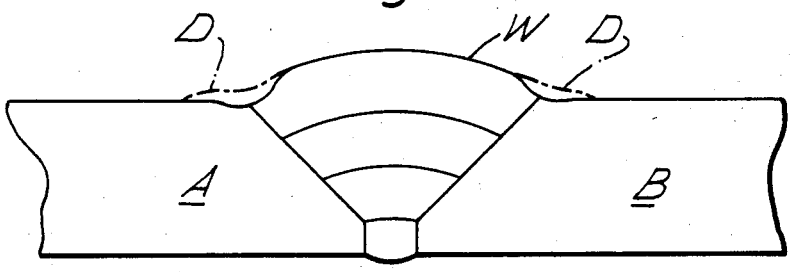
Figure 3A:
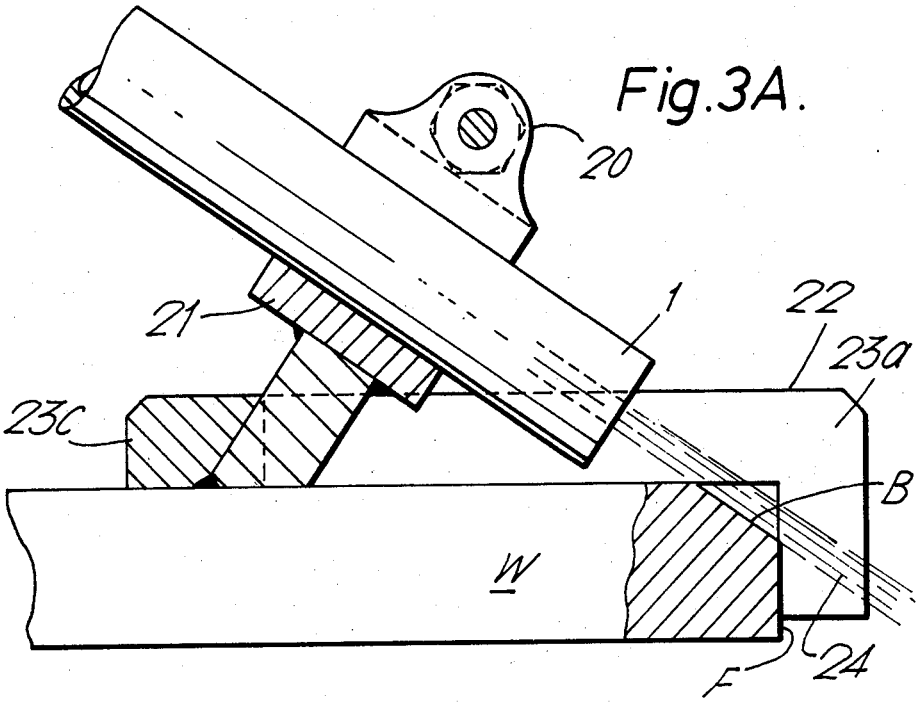
Figure 3B:
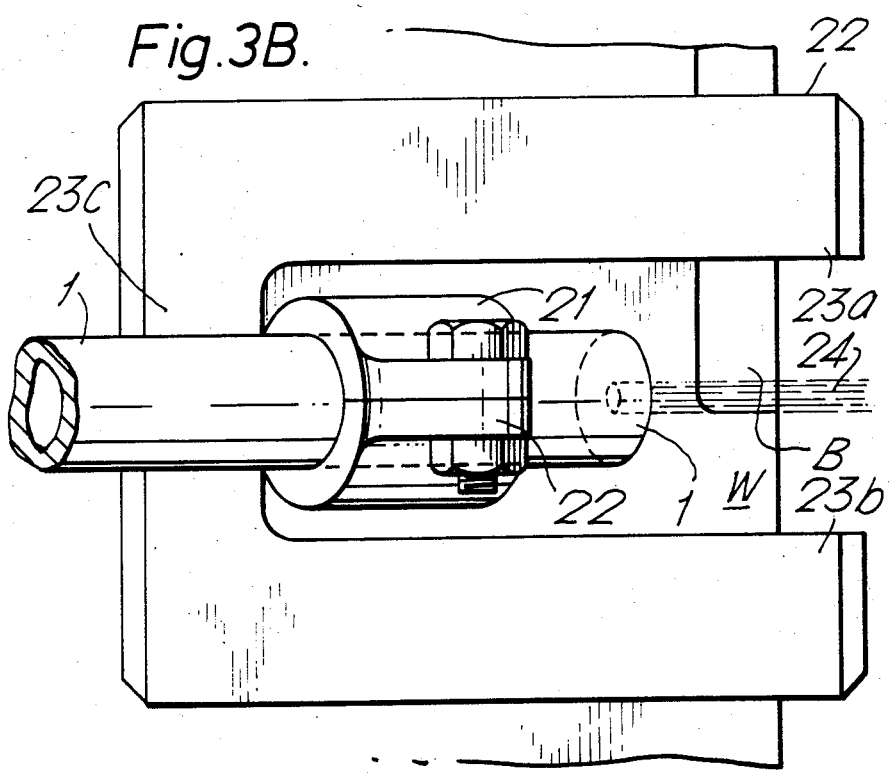

FIGS. 3*a* and 3*b* are a side elevation, partly in section, and a plan view, respectively, of an embodiment of the present invention; and FIG. 4 is a sectional view illustrating the application of the invention to the dressing of welds.

FIG. 1 shows a first embodiment of apparatus according to the present invention in which a cutting nozzle 1 is mounted for X-, Y- and Z-axis translational movement relative to a workpiece W. The mounting means provides for movement of the cutting head in directions substantially parallel to two perpendicular axes and holds the cutting head substantially perpendicular to the plane defined by these two axes. As shown, the nozzle 1 is mounted on a mounting head 3, means (not shown) such as a servo mechanism being provided to move the nozzle one up and down, i.e. in the Z-axis direction relative to the mounting head 3. The head 3 is in turn moveable lengthwise of a carriage 5 to achieve Y-axis translation and the carriage is in turn mounted on two parallel rails at 7 to provide X-axis translation.

Preferably, the cutting head one is of the type in which a particulate abrasive is entrained in the very high velocity jet of water which issues from the nozzle 1. Water and abrasive, the latter being in dry or slurry form, are delivered to the head via pipes 9 from a suitably high pressure (say 900 bar) water pump in the case of the water and from a suitable source of abrasive; the abrasive will typically be specially selected sharp sand. The abrasive may either be pumped to the cutting head 1, or, depending on the construction of the cutting head 1, be sucked into the head by the jet of water. A particularly effective construction for the cutting nozzle 1 in the embodiment of FIG. 1 and which may be used in the various other embodiments of the invention herein described is the one disclosed in our copending application No. 8222484 which was published on Mar. 30, 1983 under Publication No. 2105786 and the disclosure of which is incorporated herein by way of reference.

The X-, Y-, and Z-axis movements of the cutting nozzle 1 may be under the closed loop control of a numerical control device or suitably programmed computer to cause the outlet end of the cutting nozzle 1 to describe a path appropriate to the desired surface treatment of the workpiece W.

Figure 2C:
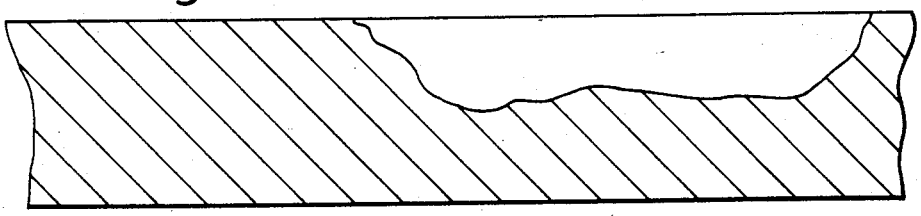

One use of the apparatus shown in FIG. 1 is the production of a 3-dimensional mould cavity such as is shown in FIGS. 2*a* to 2*c*. To produce the desired profile, the apparatus is programmed so that the head carries out a number of passes of the workpiece in either the X- or Y-axis direction and is indexed (i.e. moved through a small incremental distance) in the other of these directions between passes. The depth of cut can be controlled in a number of ways, for example varying the speed of movement of the cutting head 1 as it goes through each sweep of the workpiece, or repeating passes, or parts of passes before indexing. For removing material to a depth greater than about 50 mm, the apparatus is programmed so that the head 1 is moved in the Z direction (i.e. downwards in FIG. 1) towards the floor of the cavity being cut so that the distance between it and the portion of the floor of the cavity being cut remains below this distance. The control device which controls operation of the apparatus can readily be programmed to achieve this.

FIGS. 2*b* and 2*c* show how the profile of the cavity may be varied at different positions and, of course, the fact that the 3-dimensional shape of the cavity can be defined (and therefore stored in the control device) in terms of a succession of cross-sections along the line of traverse of the cutting head one.

The apparatus shown in FIG. 1 may as per FIGS. 2*a* to 2*c* be used to produce a metal mould for plastics injection moulding or metal casting and various other purposes. In such applications, typically 1500 $mm^3$ of steel can be erroded in one minute using one kilogram of sand and 16 meters of water delivered at 900 bar.

The apparatus of FIG. 1 can also be used for surface treatments of workpieces by greatly increasing the speed of traverse so that the jet does not dwell at any one position long enough to cause substantial cutting.

FIGS. 3*a* and 3*b* show a second embodiment of the invention, again using the concept of incomplete cutting of the workpiece. In FIGS. 3*a* and 3*b*, the intention is to produce the equivalent of a ground bevel B on the workpiece W which in this case is a piece of metal which is going to be welded at the surface B to another. Here, the nozzle 1, which may be of the same construction as in the earlier embodiment is held in a releasable clamp device 20 provided with a collar 21 which engages and holds the nozzle 1, this collar 21 being mounted on a guide 22. The guide 22, as shown in FIG. 3*b*, is, in plan, of a square "U" shape with two arms 23*a* and 23 which straddle the position at which the jet is directed at the workpiece. The collar 21 is mounted to the cross piece 23*c* of the guide. The forward end of each of the arms 23*a*, 23*b* is provided with a down turned "foot" 24 so as to position the jet accurately and ensure that it cuts along a path which is parallel to the front face F of the workpiece.

As shown in FIGS. 3*a* and 3*b*, the device 20 is so arranged that the axis of the nozzle one is held at a fixed angle relative to the upper surface of the workpiece although it is, of course, possible to arrange that this angle is adjustable by, for example, providing a pivoting mounting for the collar 21.

The device 20 can be hand-held and adapted to hold the nozzle at the specific distance to suit a particular metal. The device can be applied to joints or repairs being carried out on land or below the surface of the sea. By suitable shaping of the guide 22, the device can be adapted to flat surfaces, as in FIGS. 3*a* and 3*b* or to curved surfaces as on a pipe end. In the latter case, the two arms 23*a* and 23*b* of the guide could be adjustably pivotal relative to one another (so that the feet 24 turn in towards one another) so as to adapt the device to different diameters of pipe or different radii of curvature of other workpieces.

FIG. 4 illustrates the application of the invention to the dressing of welds. FIG. 4 shows two workpieces A and B which might, for example, be parts of the ends of two facing pipes with a weld W between them.

It has been found that by grinding small depressions D running along the length of the weld at the junction between the weld and each workpiece, the strength of the weld is greatly increased. However, it is only normally done on very critical welds such as on North Sea oil rig structures which are subjected to extra problems in a marine environment. The reason for the increase in strength is that after welding there is a surface tension set up in the weld due to stresses set up during cooling. This is most pronounced at the join between the weld and the basic metal. The interface between the two can be greatly relieved by removing material at D to a given depth which varies according to the material being welded and the conditions under which the weld has been made. Instead of removing the material at D by grinding, the present invention can be used, namely a very high velocity jet of water, preferably with abrasive material entrained in it, can be traced along each of the zones D so as to errode the weld and workpiece material to the required depth. This may be achieved by holding the nozzle 1 by hand, having it mounted in a manually moveable guide as in FIGS. 3*a* and 3*b* or by using an automated arrangement such as is shown in FIG. 1. In the latter regard it is, of course, quite normal for welds in large upright pipes to be made using a welding tool which is mounted on a welding carriage which runs round an annular track temporarily fixed to the structure being welded. It is a straightforward matter to use such a carriage to mount the water jetting nozzle.

Various other applications of the present invention will be apparent to those skilled in the art. The degree of cutting action achieved by the cutting head in embodiments of the invention is, of course, related to the liquid supply pressure, whether and what abrasive material is entrained in the jet, and the nature of the materials being cut. Certain materials may require special treatment. For example, to start the procedure a relatively low pressure (say, 1500 psi) with the jet stationaly and then increase the pressure to, say, 4000 psi when the head starts to move, so as to achieve a good cutting speed.

I claim:

1. In a method of dressing a weld of a workpiece, the weld comprising a weld bead and a surface of the workpiece adjacent the weld bead, there being a junction between the weld bead and said adjacent surface, the method comprising cutting away material along said junction between the weld bead and the adjacent surface of the workpiece to relieve stress in the weld, the improvement comprising using a high pressure liquid jetting apparatus having a high pressure liquid cutting head to direct a jet of liquid issued from the high pressure liquid cutting head at the junction between the weld bead and the adjacent surface of workpiece so as to remove material from the junction between the weld bead and the adjacent surface of the workpiece by the action of the jet on the bead and workpiece material.

2. A method according to claim 1 wherein the material cut away forms a smooth, shallow channel running along the junction between the weld bead and the adjacent part of the workpiece.

* * * * *